US005145526A

United States Patent [19]

Oldham

[11] Patent Number: 5,145,526

[45] Date of Patent: Sep. 8, 1992

[54] APPARATUS FOR FACILITATING THE SPRAYING OF ARTICLES

[75] Inventor: Terry L. Oldham, Hickory, N.C.

[73] Assignee: Hammer Metals Company, Inc., Conover, N.C.

[21] Appl. No.: 610,054

[22] Filed: Nov. 7, 1990

[51] Int. Cl.[5] ..... B05C 13/00

[52] U.S. Cl. ..... 118/319; 118/320; 118/500

[58] Field of Search ..... 118/319, 320, 500; 211/1.5

[56] References Cited

U.S. PATENT DOCUMENTS

| | | | |
|---|---|---|---|
| 2,342,375 | 2/1944 | Shurley | 118/319 |
| 2,781,020 | 2/1957 | Scott | 118/320 |
| 2,808,343 | 10/1957 | Simmons | 118/320 |
| 3,503,369 | 3/1970 | Moore | 118/313 |
| 4,944,830 | 7/1990 | Zodrow et al. | 156/567 |

*Primary Examiner*—W. Gary Jones
*Assistant Examiner*—Charles K. Friedman
*Attorney, Agent, or Firm*—Bell, Seltzer, Park & Gibson

[57] ABSTRACT

Articles to be sprayed are supported for rotative movement by article holders disposed in tiered rows that extend generally horizontally in parallel relationship to each other at different elevations. Rotative movement is imparted to the article holders and articles by endless-loop drive members that are associated with respective ones of the rows of article holders, and that are driven by a common drive motor. An adjustable assembly permits simultaneous adjustment of the tension of each of the endless-loop drive members.

11 Claims, 2 Drawing Sheets

APPARATUS FOR FACILITATING THE SPRAYING OF ARTICLES

FIELD OF THE INVENTION

This invention relates generally to an apparatus for facilitating the spraying of discrete articles, and more particularly to an apparatus for spraying articles of the type having a plurality of nonplanar surfaces that require spraying to coat the surfaces with stain, finish coating material, paint or the like. The articles to be sprayed are illustrated as being generally round legs or feet of the type used on upholstered sofas or chairs.

BACKGROUND OF THE INVENTION

A person using a hand-held spray gun to individually spray articles of the aforesaid type must either move the spray gun about the articles or move the articles relative to the spray gun. Either procedure is time consuming, and the latter procedure, if manually performed, can also result in marring of a previously sprayed surface as the article is repositioned for spraying of other of its surfaces. The foregoing problems are compounded when a relatively large number of such articles are to be sprayed.

It has been recognized that it would be advantageous to automate the spraying procedure. For example, U.S. Pat. No. 2,342,375 discloses an apparatus for applying decoration to cylindrical objects, such as bottles and the like, by positioning the bottles on a turntable and moving the same past a spray gun for applying the decoration thereto. Disc-shaped targets are moved along a conveyor and past a spray gun to apply a coating thereto in U.S. Pat. No. 2,781,020. U.S. Pat. No. 2,808,343 discloses a spraying apparatus in which the articles are transported in semicircular paths of travel around first and second spraying devices to coat all surfaces of the articles as they are moved by the spraying devices. U.S. Pat. No. 3,503,369 discloses an apparatus for spraying glue on the outer peripheral surfaces of stacked paper discs which rotate while the glue is sprayed thereon.

These prior art spraying devices are complicated and expensive to produce. These devices also require that the operation of the spray gun be coordinated with the movement of the articles past the spray gun.

SUMMARY OF THE INVENTION

With the foregoing in mind, it is an object of the present invention to provide an apparatus for facilitating the spraying of discrete articles of the above-described type which is inexpensive to construct and which is easy to use with a manually operated spray gun.

The apparatus of the present invention includes a plurality of article holders adapted to support respective ones of the articles to be sprayed. The article holders are disposed in a plurality of tiered rows that extend in generally parallel and laterally offset relationship to each other at different elevations. The article holders are mounted for rotative movement by upstanding shafts, and rotation is imparted to the article holders by drive means that includes a plurality of endless-loop drive chains or similar drive members. Each of the endless-loop drive members has a flight or run extending in generally parallel relationship to an associated one of the tiered rows of article holders. The drive means further includes a drive motor drivably connected to the endless-loop drive members. The apparatus also preferably includes tension-adjusting means for simultaneously adjusting the tension in each of the endless-loop drive members, when required. The endless-loop drive member associated with each row of the article holder has one flight or run passing in sinuous fashion between the drive shafts associated with the article holders of the associated row and rotates alternate ones of such shafts in opposite directions.

The apparatus includes a tiered frame having a plurality of platforms or steps extending in generally parallel and laterally spaced relationship to each other at different elevations. The rows of article holders are spaced from each other along the length of and above respective ones of the platforms or steps. The articles are frictionally supported in and rotated by the article holders when being sprayed, and can be easily removed therefrom when the spraying operation is completed.

BRIEF DESCRIPTION OF THE DRAWINGS

Other features of the invention will be apparent from the following description of an illustrative embodiment thereof, which should be read in conjunction with the accompanying drawings, in which.

DESCRIPTION OF THE PREFERRED EMBODIMENT

Figure 1:
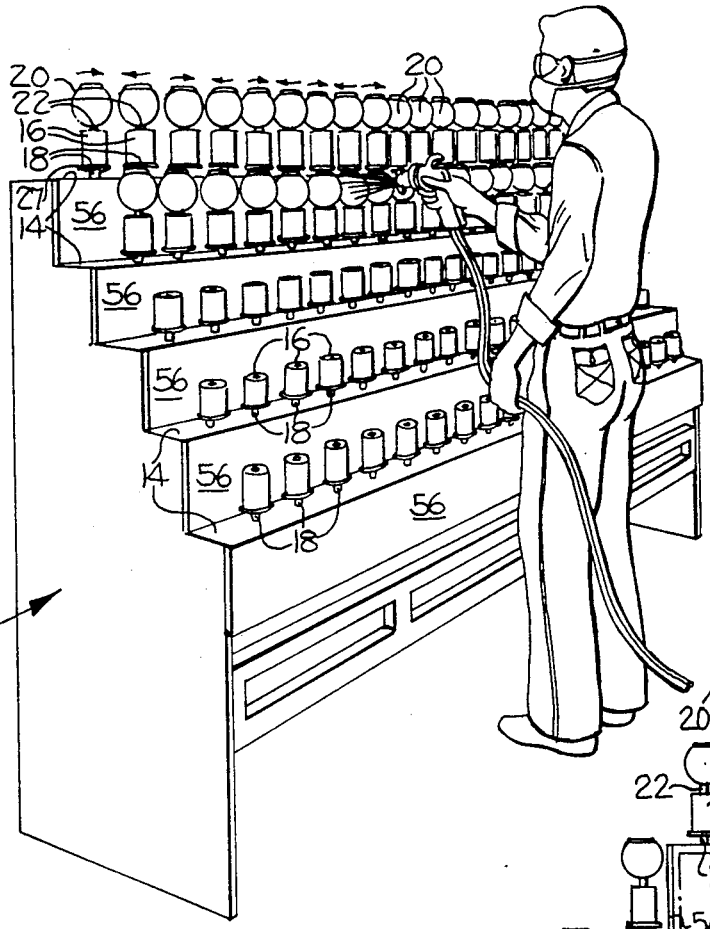
FIG. 1 is a front perspective view of the apparatus of the present invention, and showing a person spraying articles supported on only the top two rows of article holders of the apparatus.

The apparatus, as shown in FIG. 1, includes an elongate upstanding frame 12 having a plurality (illustratively five) of tiered platforms or steps 14. Platforms 14 extend longitudinally and generally horizontally of the upper portion of frame 12 in laterally adjacent and vertically spaced relationship to each other. Rows of spaced-apart article holders 16 extend upwardly from and longitudinally of respective ones of the platforms 14. The article holders 16 in each row are supported on the upper ends of underlying vertically extending drive shafts 18. Each shaft 18 is mounted for rotation about its central axes by bearings 19 (FIG. 5) fixed on the frame 12, and has a drive sprocket 44 secured thereto.

Figure 3:
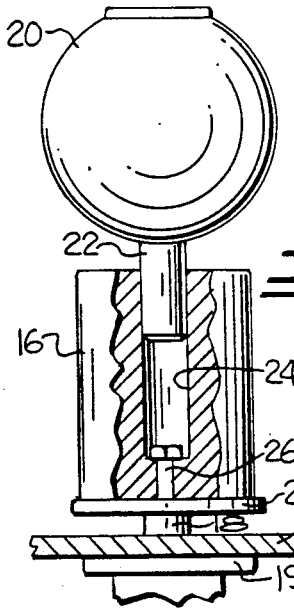
FIG. 3 is an enlarged view, primarily in elevation but partially in vertical section, of one of the article holders and adjacent components of the apparatus, and showing an article supported by the associated article holder.

Each article holder 16 is adapted to support an article 20 to be sprayed. Illustratively the articles 20 are upholstered sofa or chair legs or "feet" having a generally spherical main body. Each article 20 is adapted to be secured to the sofa or chair frame by an elongate peg 22 that extends from the article 20. Each article holder 16 is of generally cylindrical shape, and has an opening or bore 24 extending downwardly from the upper end (FIG. 3). A screw 26 within the lower portion of opening 24 secures each holder 16 and an underlying washer 27 to the internally threaded upper end portion of the corresponding vertical shaft 18 underlying the holder 6. The peg 22 of each article 20 supported by an article holder 16 projects into, and is retained by a friction fit within the upper portion of the holder's opening 24. During operation of the spraying apparatus, each article 20 therefore undergoes rotation, in a manner to be presently described, in unison with the associated holder 16 and underlying support and drive shaft 18.

Figure 2:
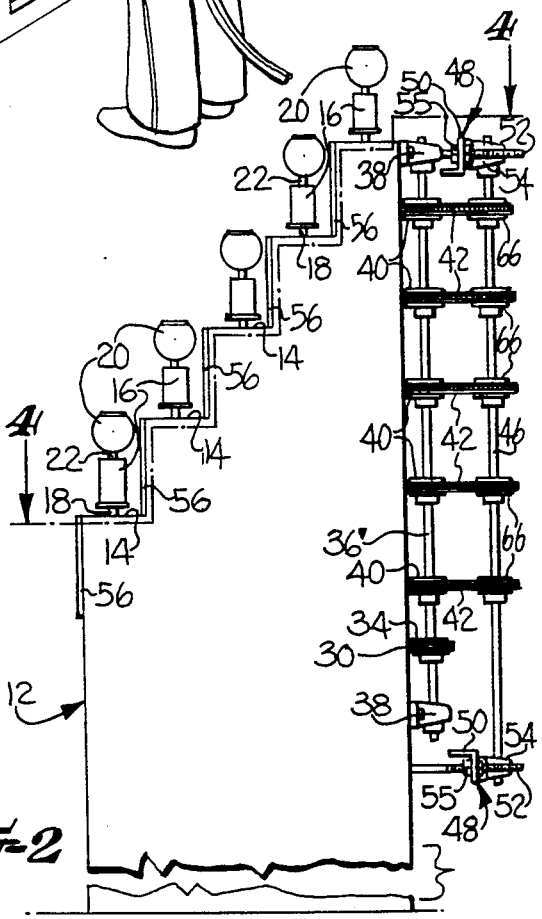
FIG. 2 is a foreshortened right side elevational view of the apparatus of FIG. 1, and showing articles mounted upon all of the rows of article holders.

The drive means by which rotative movement is simultaneously imparted at desired times to shafts 18 and article holders 16 includes a drive motor 28 (FIGS. 4 and 5) drivably connected by an endless loop drive chain 30 and sprockets 32, 34 to a vertical shaft 36 mounted adjacent one end and on the rear of frame 12 by upper and lower bearings 38. A vertical shaft 36' (FIG. 2) is mounted adjacent the other end and on the rear of the frame 12 by upper and lower bearings 38'. Each shaft 36, 36' has five respective drive sprockets 40, 40' spaced along the length thereof at equally spaced intervals.

Figure 4:
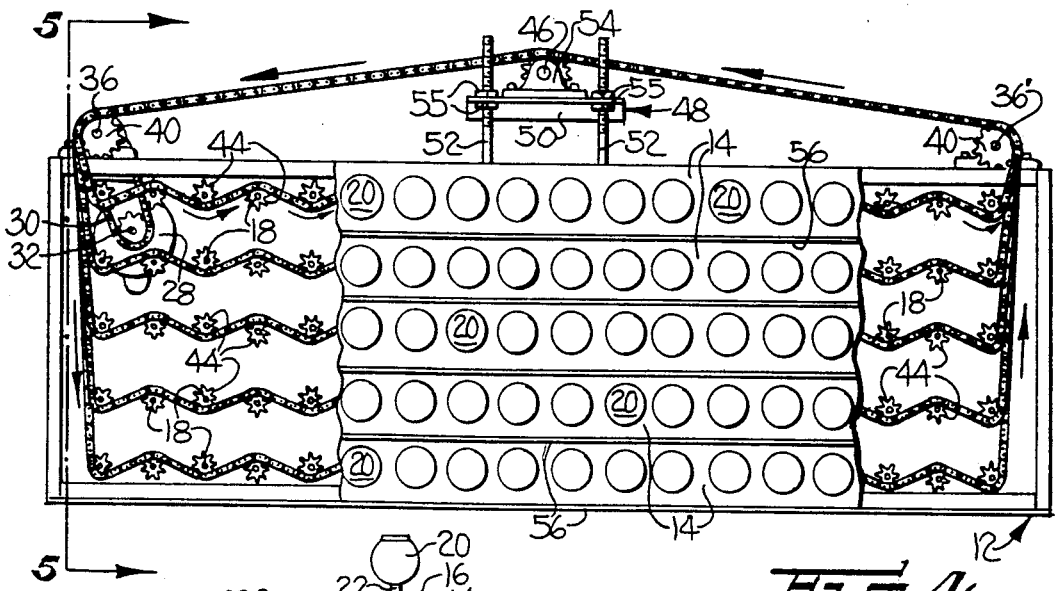
FIG. 4 is a horizontal sectional view of the apparatus taken in the direction of the arrows 4—4 of FIG. 2, and with the central portion in top plan.

The drive means further includes five endless-loop drive chain members 42 that extend generally horizontally in vertically-spaced substantially parallel relationship to each other. Each drive member 42 is driven during operation by the two drive sprockets 40, 40' of the vertical shafts 36, 36' that lie in substantially the same plane as the particular drive member 42. A forwardmost flight or run of each elongate drive member 42 extends in underlying and generally parallel relationship to an associated one of the platforms 14 and to the row of article holders 16 above such platform. Each drive member 42 drivably engages drive sprockets 44 (FIG. 5) upon the vertical shafts 18 supporting the associated article holders 16, and thereby imparts simultaneous rotation to all of the shafts 18 and article holders 16. Preferably the aforesaid forward flight or run of each of the endless chain members 42 passes in sinuous fashion about and between opposite sides of alternate ones of the sprockets 44 engaged thereby, such that alternate ones of the shafts 18 in each row are rotated in opposite clockwise/counterclockwise directions, as shown in FIG. 4. Since all of the endless-loop drive members 42 are driven simultaneously at the same rate, all article holders 16 undergo simultaneous rotation during operation of the apparatus.

Figure 5:
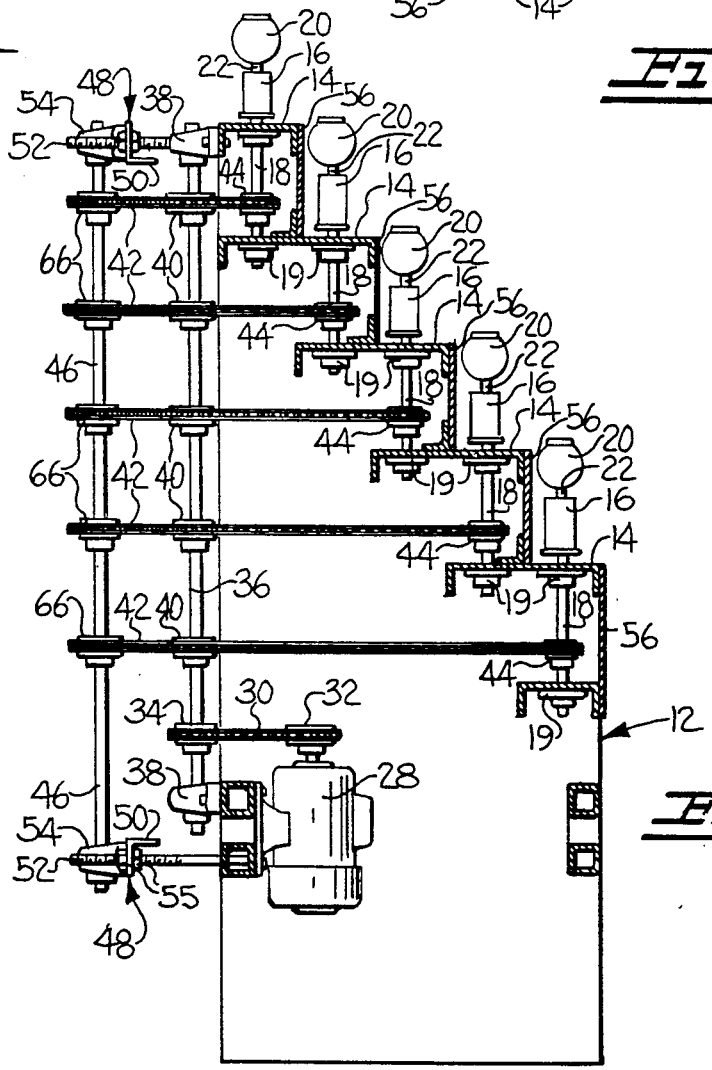
FIG. 5 is a vertical sectional view taken along the line 5—5 of FIG. 4.

The apparatus preferably and illustratively further includes tension-adjusting means for facilitating adjustment, when and if required, of the tension of the endless-loop drive members 42. The illustrated tension-adjusting means includes an additional vertically extending shaft 46 mounted adjacent the center and on the rear of frame 12 by upper and lower mounting assemblies, broadly indicated at 48. Each mounting assembly 48 includes a bracket 50 that is mounted by threaded rods 52 for adjustive movement in a forward/rearward direction relative to frame 12 upon rotation in appropriate directions of nuts 55 upon the rods 52. Each assembly 48 further includes a bearing 54 that is movable with bracket 50 and that supports upper and lower end portions of shaft 46 for movement therewith. Sprockets 66 are fixedly secured to shaft 46 and lie at the same elevation as, and are entrained by, corresponding ones of the five endless drive members 42 (FIG. 5). Adjustment of the position of shaft 46 in a forward-rearward direction therefore simultaneously adjusts the tension of each chain member 42.

While automatic means might be employed to spray the rotating articles 20 during operation of the apparatus, illustratively the spraying is performed by an individual standing in front of the apparatus and utilizing a hand-held spray gun (FIG. 1). Before spraying begins, the operator manually places the peg of each article 20 in the opening 24 of each of the five rows of article holders 16. When an article 20 is frictionally supported in each article holder 16, the motor 28 is turned on to begin rotation of all five rows of articles 20. The operator then moves the spray gun along each row of articles, starting with the top row, and spraying each row of rotating articles 20 to the bottom row to coat each article. By the time the operator has completed the spraying of the articles 20 on the bottom row and turned off the drive motor 28, the coating sprayed on the top row of articles 20 will be sufficiently dry that the operator can start removing the sprayed articles 20 on the top row and replacing them with articles 20 to be sprayed. After all rows of sprayed articles 20 have been removed and replaced with articles 20 to be sprayed, the drive motor 28 is again started to start another spraying cycle. The height of the apparatus is such that the articles in each of the rows can be conveniently sprayed in the foregoing fashion without significant stretching or bending movement of the individual doing the spraying operation. Vertically extending panels 56 are fixed on the frame 12 and extend above the horizontally extending platforms or steps 14 to prevent the spray coating from the spray gun to be sprayed on the drive chains 42, sprockets 44 and vertical drive shafts 18.

While the previously-described construction of article holder 16 is well suited for spraying of the illustrated furniture legs or feet 20, it is, of course, understood that the present invention is not restricted to such articles and article holders. For instance, the article holders might employ clamps, chuck-type jaws or the like to engage the articles to be sprayed.

While a specific embodiment of the invention has been shown and described, it is to be understood that this was for purposes of illustration only, and not for purposes of limitation, the scope of the invention being in accordance with the following claims.

That which is claimed:

1. Apparatus for facilitating the spraying of a plurality of discrete articles, comprising:

a plurality of tiered rows of article holders extending in generally parallel and laterally offset relationship to each other at different elevations, each of said rows of article holders including a plurality of spaced apart article holders adapted to support respective articles during spraying thereof;

mounting means supporting said article holders for rotative movement; and driving means for imparting said rotative movement to said article holders, said drive means including a plurality of endless-loop drive members, each of said endless-loop drive members having a flight operatively associated with and extending in generally parallel relationship to an associated one of said tiered rows of said article holders, and said drive means including a drive motor drivably connected to each of said endless-loop drive members.

2. Apparatus as in claim 1, and further including tension adjusting means for simultaneously adjusting the tension of each of said endless-loop drive members.

3. Apparatus as in claim 1, wherein said article holder mounting means includes a plurality of rotatable drive shafts each supporting an associated one of said article holders and each having a drive sprocket thereon, said flight of each of said endless-loop drive members drivably engaging said drive sprockets upon said drive shafts supporting said article holders of the associated one of said tiered rows.

4. Apparatus as in claim 1, wherein said drive means drives alternate ones of said article holders in each of said tiered rows in opposite directions.

5. Apparatus as in claim 1, and further including a tiered frame having a plurality of tiered platforms extending in generally parallel and laterally spaced relationship to each other at different elevations, each of said rows of said article holders being located above and extending along the length of a respective one of said platforms.

6. Apparatus as in claim 1, wherein each of said article holders has an opening therein adapted to receive an element connected to and projecting from a therewith associated one of said articles.

7. Apparatus as in claim 6, wherein each of said article holders is of generally cylindrical shape and said opening therein extends generally axially thereof.

8. Apparatus as in claim 7, and further including a washer member connected to and extending beneath each of said article holders.

9. Apparatus as in claim 7, wherein said drive means includes a plurality of rotatable support shafts underlying respective ones of said article holders, and a driven sprocket upon each of said support shafts.

10. Apparatus as in claim 9, and further including screw means securing each of said sprockets upon the upper end of the underlying one of said shafts.

11. Apparatus as in claim 9, wherein said element connected to and projecting from each of said article holders has a frictional fit with said opening of the associated one of said article holders.

* * * * *